US007110325B2

(12) United States Patent
Ihashi

(10) Patent No.: US 7,110,325 B2
(45) Date of Patent: Sep. 19, 2006

(54) ELECTRONIC TIMEPIECE

(75) Inventor: Tomohiro Ihashi, Chiba (JP)

(73) Assignee: Seiko Instruments Inc., (JP)

( * ) Notice: Subject to any disclaimer, the term of this patent is extended or adjusted under 35 U.S.C. 154(b) by 0 days.

(21) Appl. No.: 11/286,372

(22) Filed: Nov. 23, 2005

(65) Prior Publication Data

US 2006/0109747 A1 May 25, 2006

(30) Foreign Application Priority Data

Nov. 25, 2004 (JP) ..... 2004-340358

(51) Int. Cl.
*G04B 19/24* (2006.01)
*G04B 19/27* (2006.01)
*G04C 9/00* (2006.01)

(52) U.S. Cl. ..... 368/28; 368/34

(58) Field of Classification Search ..... 368/28, 368/29, 34, 35, 37, 185, 187, 190
See application file for complete search history.

(56) References Cited

U.S. PATENT DOCUMENTS 4,300,222 A * 11/1981 Nitta ..... 368/37
4,459,031 A * 7/1984 Perucchi ..... 368/69
5,119,349 A * 6/1992 Muto et al. ..... 368/157
6,046,964 A * 4/2000 Higuchi et al. ..... 368/28
6,385,136 B1 * 5/2002 Higuchi et al. ..... 368/28
6,477,114 B1 * 11/2002 Mutoh et al. ..... 368/28
2001/0028605 A1 * 10/2001 Higuchi et al. ..... 368/37
2004/0264303 A1 * 12/2004 Brida et al. ..... 368/110

FOREIGN PATENT DOCUMENTS

JP 11202060 7/1999
JP 3002969 10/1999

* cited by examiner

*Primary Examiner*—Vit W. Miska
(74) *Attorney, Agent, or Firm*—Adams & Wilks

(57) ABSTRACT

To provide an electronic timepiece having a simple constitution, being excellent in durability in an electronic timepiece and made to change date display of date display means in accordance with rotation of a time hand. A 24 o'clock detecting switch detects 24 o' clock. A crown rotation switch is made ON when a crown for rotating a time hand is rotated regularly by a predetermined angle and a crown rotation switch is made ON when the crown is rotated reversely by the predetermined angle. A control circuit determines whether a rotational direction of the crown is regular rotation or reverse rotation based on the numbers of operating the crown rotation switches ON, when the 24 o'clock detecting switch detects 24 o'clock, the control circuit 106 regularly rotates or reversely rotates date display of the date display means in the direction in accordance with a result of determination of the direction of rotating the crown to change date to tomorrow or yesterday.

4 Claims, 5 Drawing Sheets

ELECTRONIC TIMEPIECE

BACKGROUND OF THE INVENTION

Field of the Invention

The present invention relates to an electronic timepiece for changing a date display of date display means in accordance with rotation of a time hand.

In a background art, a function of a date display is provided as an additional function of a timepiece, and there is a function of a displaying date for determining whether date feeding is performed in a progressing direction of date (tomorrow) or a regressing direction of date (yesterday) in cooperation with movement of an indicating hand of a timepiece (determination of regular or reverse feeding of date) (refer to, for example, Patent Reference 1, Patent Reference 2).

According to an electronic timepiece described in Patent Reference 1, mentioned above, two pieces of switches for determining a regular or reverse rotational direction of date. The two pieces of switches are always brought into contact with a board even in normally hand-moving at which correction of time is not carried out and therefore durability of the switches poses a problem.

Further, according to an electronic timepiece described in Patent Reference 2, although switches are not always brought into contact with a board, 3 pieces of switches are used. Therefore even when time correction is not carried out, the switches are brought into contact with contacts 3 times per day and durability of the switches poses a problem.

<Patent Reference 1>Japanese Patent Publication No.

<Patent Reference 2>JP-A-11-202060

The invention has been carried out in order to resolve the above-described problem and it is an object to provide an electronic timepiece having a simple constitution and excellent in durability.

SUMMARY OF THE INVENTION

According to the invention, there is provided an electronic timepiece characterized in an electronic timepiece made to change a date display of date display means in accordance with rotation of a time hand, the electronic timepiece including operating means for rotating the time hand, a 24 o'clock detecting switch for detecting 24 o'clock, a first switch and a second switch for executing a switching operation in accordance with an operation of rotating the operating means, rotational direction determining means for determining whether a rotational direction of the operating means is regular rotation or reverse rotation based on the numbers of operating to switch the first and the second switches, and control means for changing the date display of the date display means in accordance with a result of determination of the rotational direction determining means, wherein when the 24 o'clock detecting switch detects 24 o'clock, the control means changes the date display of the date display means in the direction in accordance with the result of determining the rotational direction of the operating means by the rotational direction determining means. When the 24 o'clock detecting switch detects 24 o'clock, the control means changes the date display of the date display means in the direction in accordance with the result of determination of the rotational direction of the operating means by the rotational direction determining means.

Here, there may be constructed a constitution in which the rotational direction determining means determines the rotational direction of the operating means based on difference between the numbers of switching operation of the first and the second switches when the 24 o'clock detecting switch detects 24 o'clock, in which when the rotational direction of the operating means is determined to be the regular rotation, the control means regularly rotates the date display of the date display means to change to the date of tomorrow and in which when the rotational direction of the rotating means is determined to be the reverse rotation, the control means reversely rotates the date display of the date display means to change to yesterday.

Further, there may be constructed a constitution in which the first switch is made ON at each time of operating to rotate the operating means in the regular direction by a predetermined angle, the second switch is made ON at each time of operating to rotate the operating means in the reverse direction by the predetermined angle, and the rotational direction determining means determines the rotational direction of the operating means based on difference between the numbers of times of making the first and the second switches ON.

Further, there may be constructed a constitution in which the operating means is a crown.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

An electronic timepiece according to an embodiment of the invention will be explained as follows.

Figure 1:
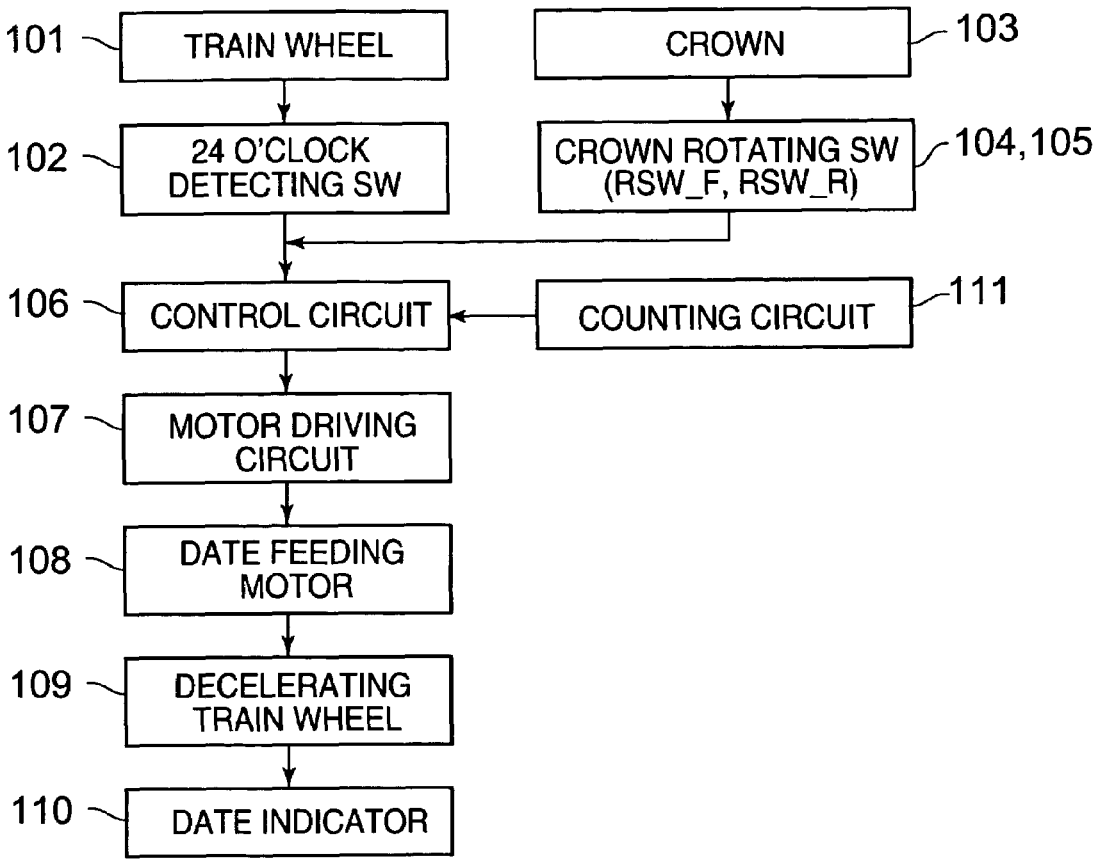
FIG. 1 is a block diagram of an electronic timepiece according to an embodiment of the invention.

FIG. 1 is a block diagram of the electronic timepiece according to the embodiment of the invention. The electronic timepiece according to the embodiment is an example of an electronic timepiece of a so-to-speak 2 motors type having a motor for driving to rotate a time hand (hour hand, minute hand or second hand) and a motor for driving to rotate date display means.

In FIG. 1, the electronic timepiece includes a train wheel 101 which is a mechanism for driving to rotate the timehand, a 24 o'clock detecting switch 102 for detecting 24 o'clock, a crown 103 as operating means, 2 pieces of crown rotation switches 104, 105 as a first switch and a second switch for detecting a rotational direction of the crown 103, a control circuit 106 for controlling respective constituent elements and a total of the electronic timepiece, a motor driving circuit 107 for driving to rotate a motor (not illustrated) for driving the timehand and a date feeding motor 108, the date feeding motor 108 changing a date display of the date display means by driving to rotate the date display means, a decelerating train wheel 109 for decelerating rotation of the date feeding motor, a date indicator 110 driven to rotate by the decelerating train wheel for changing the date display of the date display means and a counting circuit 111 for carrying out a counting operation.

Further, the control circuit 106 constitutes rotational direction determining means and control means. Further, the motor driving circuit 107, the date feeding motor 108, the decelerating train wheel 109 and the date indicator 110 as well as the control circuit 106 constitute control means for changing the date display of the date display means in a direction in accordance with a result of determining a rotational direction of the crown 103 by the rotational direction determining means when 24 o'clock is detected by the 24 o'clock detecting switch 102.

Figure 2:
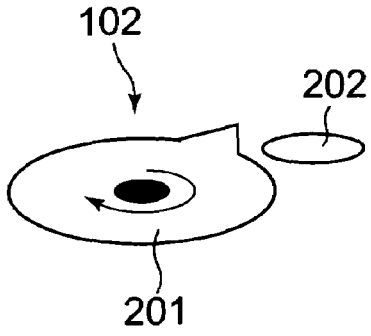
FIG. 2 is a constitution view of a 24 o'clock detecting switch used in the embodiment of the invention.

FIG. 2 is a constitution view showing an outline constitution of the 24 o'clock detecting switch 102. The 24 o'clock detecting switch 102 includes a movable contact 201 driven to rotate by a time hand driving motor (not illustrated) and a fixed contact 202 fixed to a predetermined position in the electronic timepiece. The movable contact 201 is a contact rotated by one rotation in 24 hours, the contact 201 and the contact 202 are brought into contact with each other and the 24 o'clock detecting switch 102 is made ON at each time of reaching 24 o'clock.

Figure 3:
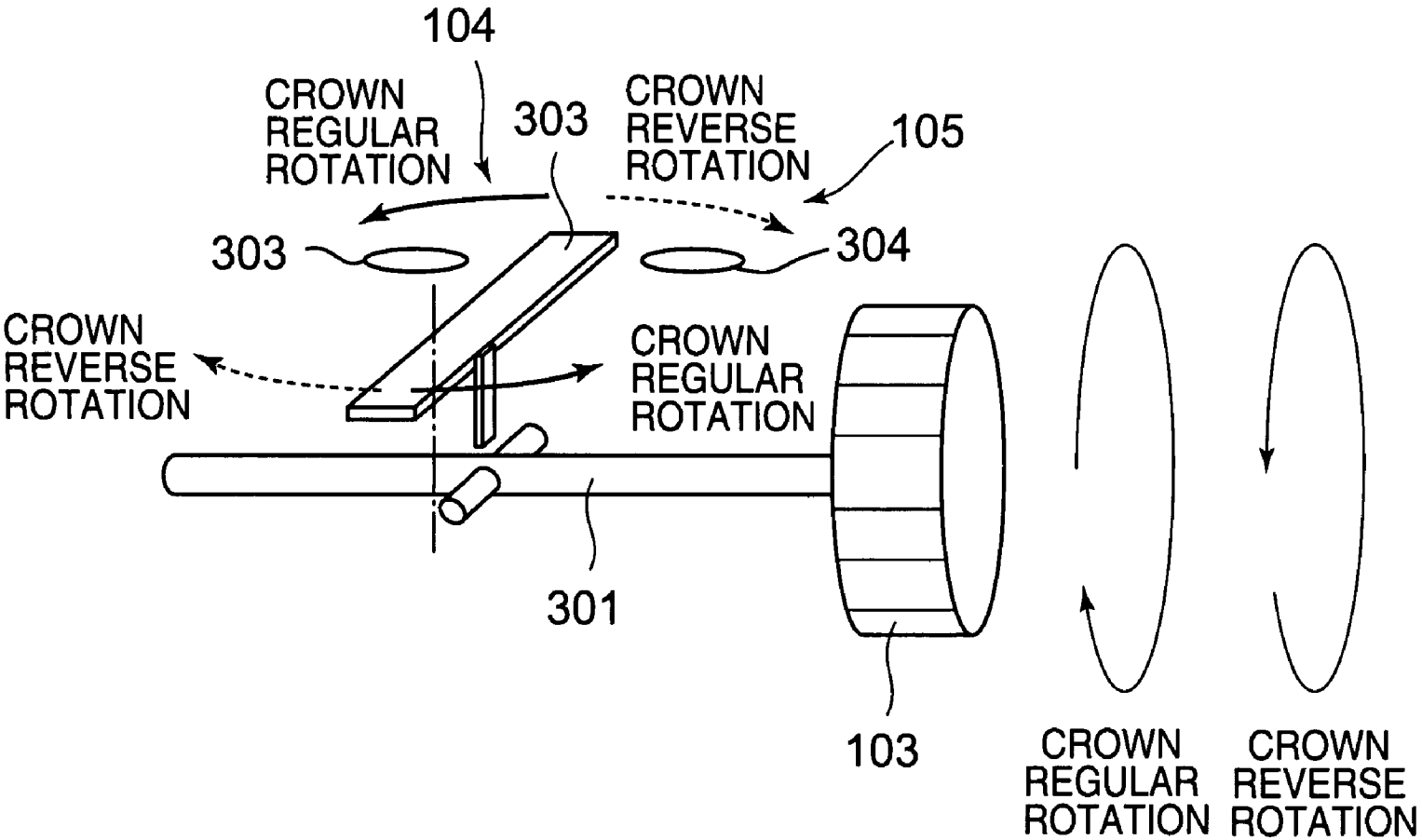
FIG. 3 is an outline constitution view of a crown rotating switch and a peripheral portion thereof used in the embodiment of the invention.

FIG. 3 is a constitution view showing an outline of the crown rotation switches 104, 105 and a peripheral portion thereof. In FIG. 3, when the crown 103 is rotated, a shaft 301 is rotated in a direction in accordance with the rotational direction, and a movable contact 302 is rotated in a direction in accordance with rotation of the shaft 301. The movable contact 302 is brought into contact with a fixed contact 303 or a fixed contact 304 fixed to predetermined positions of the electronic timepiece in accordance with the rotational direction of the movable contact 302, and the first switch (RSW_F) 104 or the second switch (RSW_R) 105 to which the movable contact 302 is brought into contact are made ON.

Further, the switch (RSW_F) 104 is constituted to be made ON at each time of operating to rotate (regularly rotate) the crown 103 by a predetermined angle in a regular rotation, further, the switch (RSW_R) 105 is constituted to be made ON at each time of operating to rotate (reversely rotate) the crown 103 by the predetermined angle in a reverse direction (for example, the switches 104, 105 are respectively made ON at each time of rotating the crown 103 by a half rotation). The predetermined rotational angle of the crown 103 for making the switch (RSW_F) 104 ON and the predetermined rotational angle of the crown 103 for making the switch (RSW_R) 105 ON are set to the same angle although the rotational directions are reverse to each other.

Figure 4:
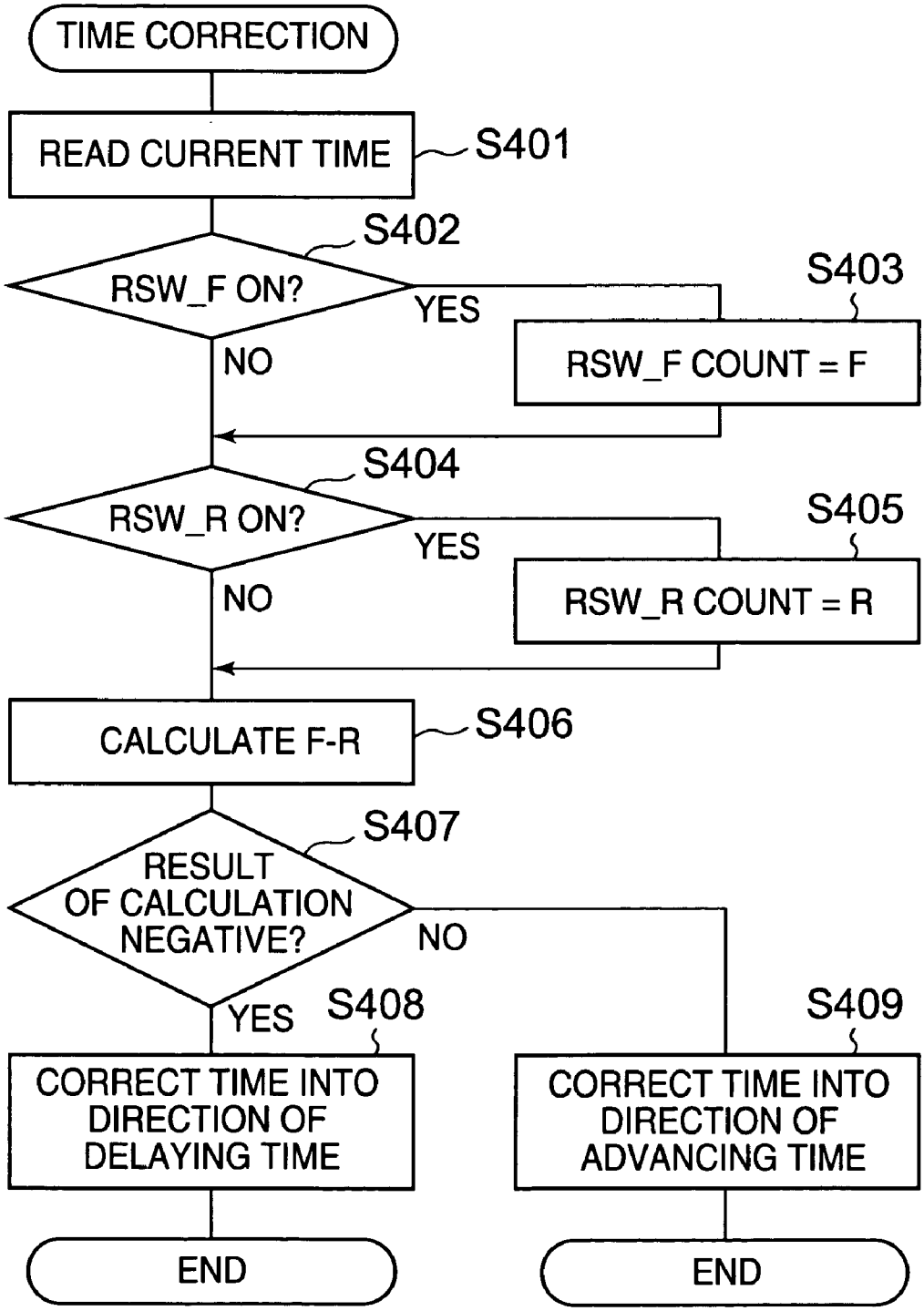
FIG. 4 is a flowchart showing a time correcting processing of the electronic timepiece according to the embodiment of the invention.

FIG. 4 is a flowchart showing a time correcting processing of the electronic timepiece according to the embodiment of the invention and is a flowchart mainly showing a processing of the control circuit 106.

FIG. 6 illustrates timing charts for explaining the time correcting processing and the date display changing processing of the electronic timepiece according to the embodiment of the invention.

When time correction is carried out, the user carried out a predetermined operation (for example, operation of drawing the crown 103) and time correction is started by detecting the operation by the control circuit 106.

According to the time correcting processing, first, in FIG. 4, the control circuit 106 reads current time counted by the counting circuit 111 (step S401), and determines whether the switch (RSW_F) 104 is made ON (step S402) When the control circuit 106 determines that the switch (RSW_F) 104 is not made ON at step S402, the control circuit 106 determines whether the switch (RSW_R) 105 is made ON (step S404).

When the control circuit 106 determines that the switch (RSW_F) 104 is made ON at step S402, the control circuit 106 stores a number F of times of making the switch 104 ON to a memory (not illustrated) as a count value (step S403), and when the control circuit 106 determines that the switch (RSW_R) 105 is made ON at step S404, the control circuit 106 stores the number R of times of making the switch 105 ON to the memory as a count value (step S405).

Further, as described above, in accordance with the operation of rotating the crown 103, the switch (RSW_F) 104 is made ON at each time of operating to rotate the crown 103 in the regular direction (regular rotation) by the predetermined angle, the switch 105 (RSW_R) is made ON at each time of operating to rotate the crown 103 in the reverse direction (reverse rotation) by the predetermined angle, and the control circuit 106 respectively counts the numbers of times of making the switch (RSW_F) 104 and the switch 105 (RSW_R) ON to store it to the memory.

Figure 6A:
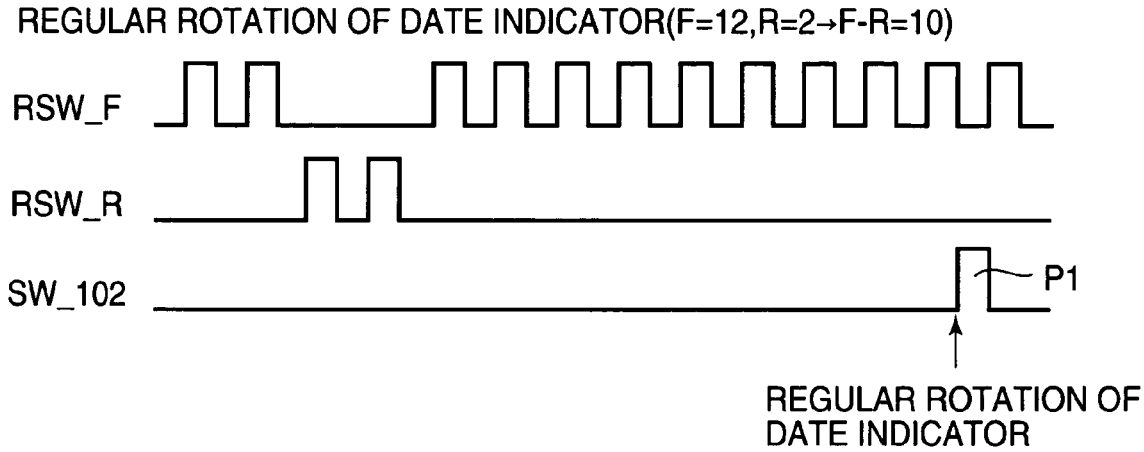
FIG. 6 illustrates time charts for explaining a date correcting processing and a date display changing processing of the electronic timepiece according to the embodiment of the invention.
Figure 6B:
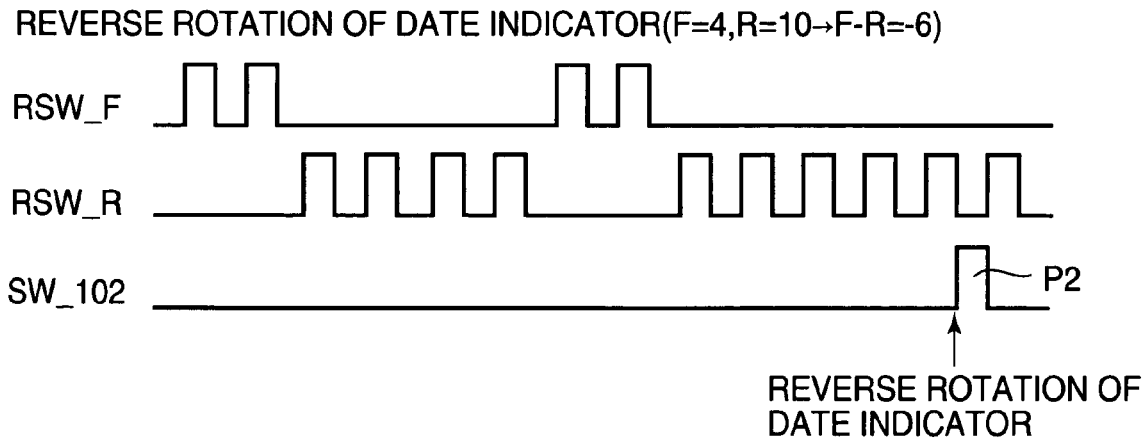

FIG. 6A shows that by operating to rotate the crown 103 regularly and reversely, the switch (RSW_F) 104 is made ON by 12 times and the switch 105 (RSW_R) is made ON by 2 times. Further, FIG. 6B shows that by operating to rotate the crown 103 regularly and reversely, the switch (RSW_F) 104 is made ON by 4 times and the switch 105 (RSW_R) is made ON by 10 times.

Next, the control circuit 106 calculates a difference (F−R) between the numbers of times of making the switch 104 and the switch 105 ON (step S406) and determines an amount of the difference (F−R) (step S407). Further, in the case of FIG. 6A, the difference (F−R)=10 and in the case of FIG. 6B, the difference (F−R)=−6.

When the control circuit 106 determines that the difference (F−R) is negative at step S407, that is, when the crown 103 is operated to rotate more in reverse rotation than in regular rotation (corresponding to for example of FIG. 6B), the control circuit 106 corrects time to delay time by a time period in correspondence with the difference (F−R) to finish the processing (step S408).

Further, when the control circuit 106 determines that the difference (F−R) is positive at step S407, that is, when the crown 103 is operated to rotate more in regular rotation than in reverse rotation (correspond to the example of FIG. 6A), the control circuit 106 corrects time to advance time by a time period in correspondence with the difference (F−R) to finish the processing (step S409).

Figure 5:
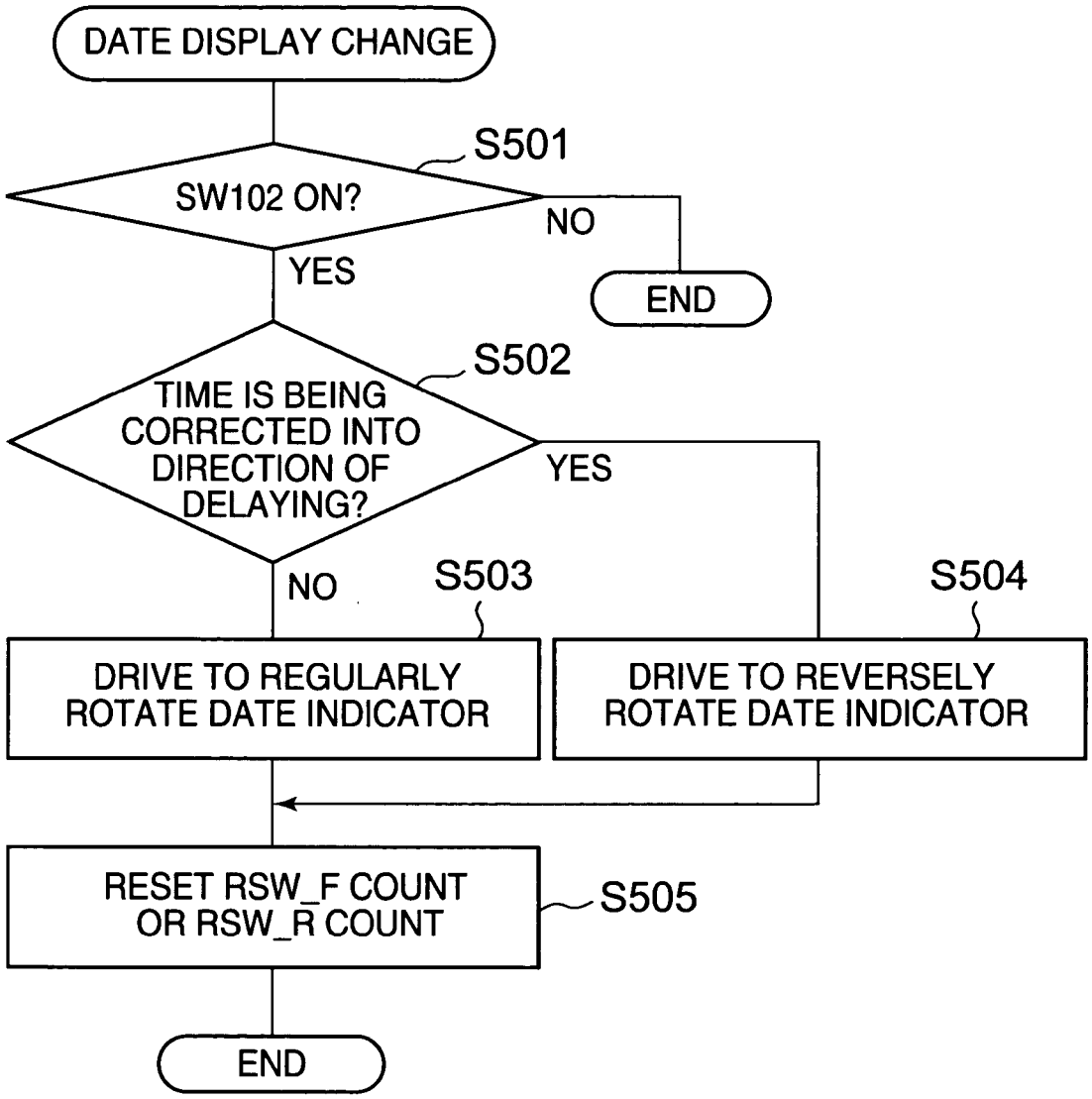
FIG. 5 is a flowchart showing a date display changing processing of the electronic timepiece according to the embodiment of the invention.

Next, the date display changing processing will be explained. FIG. 5 is a flowchart showing the date display changing processing of the electronic timepiece according to the embodiment of the invention and is a flowchart mainly showing the processing of the control circuit 106.

In FIG. 5, the control circuit 106 determines whether the 24 o'clock detecting switch 102 is made ON and when it is determined that the 24 o'clock detecting switch 102 is not made ON, the control circuit 106 finishes the processing (step S501).

When the control circuit 106 determines that the 24 o'clock detecting switch 102 is made ON at step S501, the control circuit 106 determines whether the rotational direction of the crown 103 is being corrected into a direction of delaying time (step S502). Here, the processing step S502 constitutes rotational direction determining means. Further, the determination of whether time is being corrected into the direction of delaying time at the step S502 is carried out by carrying out the time correcting direction determining processing of steps S402 through S407 of FIG. 4.

When the control circuit 106 determines that the rotational direction of the crown 103 is correcting time into the direction of advancing time at step S502, the control circuit 106 drives to rotate regularly the date indicator 110 by a predetermined amount by supplying a regularly rotating drive pulse (pulse P1 of FIG. 6A) to the date feeding motor 108 by controlling the motor driving circuit 107, to change the date display of the date display means in the regularly rotating direction (tomorrow) (step S503).

On the other hand, when the control circuit 106 determines that the rotational direction of the crown 103 is correcting time into the direction of delaying time at the step S502, the control circuit 106 drives to rotate reversely the date indicator 110 by the predetermined amount by supplying a reversely rotating drive pulse (pulse P2 of FIG. 6B) to the date feeding motor 108 by controlling the motor driving circuit 107, to change the date display of the date display means in the reversely rotating direction (yesterday) (step S504) Further, the processing steps S503, S504 constitute the controlling means.

After steps S503 and S504, the control circuit 106 resets values of ON time numbers of the switch (RSW_F) 104 and the switch (RSW_R) 105 stored to the memory to null to finish the processing (step S505).

As described above, the electronic timepiece according to the embodiment of the invention is constituted such that in the electronic timepiece made to change the time display of the time display means in accordance with rotation of the time hand, or the electronic timepiece made to change the date display in accordance with rotation of the time hand, the electronic timepiece includes the crown 103 for rotating the time hand, the 24 o'clock detecting switch 102 for detecting 24 o'clock, the first and the second switches 104, 105 operated to switch in accordance with the operation of rotating the crown 103, the rotational direction determining means for determining whether the direction of rotating the crown 103 is regular rotation or reverse rotation based on the numbers of operating to switch the first and the second switches 104, 105, and the control means for changing the date display in accordance with the result of determination by the rotational direction determining means, in which when the 24 o'clock detecting switch 102 detects 24 o'clock, the control means changes the date display in the direction in accordance with the result of determining the rotational direction of the crown 103 by the rotational direction determining means.

Here, the rotational direction determining means determines the direction of rotating the crown 103 based on the difference between the numbers of operating to switch the first, the second switches 104, 105 when the 24 o'clock detecting switch 102 detects 24 o'clock, the control means changes the date to tomorrow by regularly rotating the date display when the direction of rotating the crown 103 is determined to be regular rotation and changes the date to yesterday by reversely rotating the date display when the rotational direction of the crown 103 is reverse rotation.

Further, the first switch 104 is made ON at each time of operating the crown 103 by the predetermined angle in the regular direction, the second switch 105 is made ON at each time of operating the crown 13 by the predetermined angle in the reverse direction, and the rotational direction determining means determines the rotational direction of the crown 103 based on the times of making the first and the second switches 104, 105 ON.

Therefore, the switch which is made ON every 24 hours is the single piece of the 24 o'clock detecting switch 102 and therefore, in comparison with the electronic timepiece using 3 pieces of the switches or the electronic timepiece in which 2 pieces of the switches are always brought into contact with the board, mentioned above, durability of the switch is promoted. Further, the switch which is made ON in cooperation of the train wheel is the single piece of the 24 o'clock detecting switch 102 and therefore, a space at a surrounding of the train wheel at inside of the timepiece can be reduced to achieve an effect of enabling to downsize the electronic timepiece.

According to the invention, the electronic timepiece having a simple constitution and being excellent in durability can be provided. Further, an effect of capable of downsizing the electronic timepiece is achieved.

The invention is applicable not only to an electronic wristwatch but also to an electronic clock or the like.

What is claimed is:

1. An electronic timepiece comprising:

operating means rotatable in regular and reverse directions for rotating a time hand;

a 24 o'clock detecting switch for detecting 24 o'clock;

a first switch and a second switch for executing a switching operation in accordance with an operation of rotating the operating means;

rotational direction determining means for determining whether a rotational direction of the operating means is regular rotation or reverse rotation based on the numbers of operations to switch the first and the second switches; and control means for changing a date display of a date display means in accordance with a result of determination of the rotational direction determining means;

wherein when the 24 o'clock detecting switch detects 24 o'clock, the control means changes the date display of the date display means in the direction in accordance with the result of determining the rotational direction of the operating means by the rotational direction determining means.

2. An electronic timepiece according to claim 1, wherein the rotational direction determining means determines the rotational direction of the operating means based on a difference between the numbers of switching operation of the first and the second switches when the 24 o'clock detecting switch detects 24 o'clock, that when the rotational direction of the operating means is determined to be the regular rotation, the control means regularly rotates the date display of the date display means to change to the date of tomorrow, and that when the rotational direction of the rotating means is determined to be the reverse rotation, the control means reversely rotates the date display of the date display means to change to the date of yesterday.

3. An electronic timepiece according to claim 2, wherein the first switch is made ON at each time of operating to rotate the operating means in the regular direction by a predetermined angle, the second switch is made ON at each time of operating to rotate the operating means in the reverse direction by the predetermined angle, and the rotational direction determining means determines the rotational direction of the operating means based on a difference between the numbers of times of making the first and the second switches ON.

4. An electronic timepiece according to claim 1, wherein the operating means is a crown.

* * * * *